US005641932A

United States Patent [19]

Lace

[11] Patent Number: 5,641,932

[45] Date of Patent: Jun. 24, 1997

[54] SENSOR ASSEMBLY FOR STRINGED MUSICAL INSTRUMENTS

[75] Inventor: Jeffrey J. Lace, Huntington Beach, Calif.

[73] Assignee: Actodyne General, Inc., Huntington Beach, Calif.

[21] Appl. No.: 374,292

[22] Filed: Jan. 19, 1995

[51] Int. Cl.[6] ..... G10H 3/18

[52] U.S. Cl. ..... 84/727

[58] Field of Search ..... 84/726

[56] References Cited

U.S. PATENT DOCUMENTS

| | | | |
|---|---|---|---|
| Re. 32,520 | 10/1987 | Lace . | |
| 2,089,171 | 8/1937 | Beauchamp . | |
| 2,119,584 | 6/1938 | Knoblaugh . | |
| 2,175,325 | 10/1939 | Sunshine . | |
| 2,209,016 | 7/1940 | Dickerson . | |
| 2,294,861 | 9/1942 | Fuller . | |
| 2,445,046 | 7/1948 | Tinkham . | |
| 2,557,754 | 6/1951 | Morrison . | |
| 2,567,570 | 9/1951 | McCarty . | |
| 2,573,254 | 10/1951 | Fender . | |
| 2,612,541 | 9/1952 | DeArmond . | |
| 2,683,388 | 7/1954 | Keller . | |
| 2,725,778 | 12/1955 | Cronwell . | |
| 2,764,052 | 9/1956 | McBride . | |
| 2,817,261 | 12/1957 | Fender . | |
| 2,892,371 | 6/1959 | Butts . | |
| 2,896,491 | 7/1959 | Lover . | |
| 2,909,092 | 10/1959 | De Armond et al. . | |
| 2,911,871 | 11/1959 | Schultz . | |
| 2,968,204 | 1/1961 | Fender . | |
| 2,976,755 | 3/1961 | Fender . | |
| 3,066,567 | 12/1962 | Kelley, Jr. . | |
| 3,183,296 | 5/1965 | Miessner . | |
| 3,236,930 | 2/1966 | Fender . | |
| 3,249,677 | 5/1966 | Burns et al. . | |
| 3,290,424 | 12/1966 | Fender . | |
| 3,417,268 | 12/1968 | Lace . | |
| 3,483,303 | 12/1969 | Warner . | |
| 3,530,228 | 9/1970 | Scherer . | |
| 3,535,968 | 10/1970 | Rickard . | |
| 3,539,700 | 11/1970 | Johnson | 84/727 |
| 3,541,219 | 11/1970 | Abair . | |
| 3,571,483 | 3/1971 | Davidson . | |
| 3,588,311 | 6/1971 | Zoller . | |
| 3,602,627 | 8/1971 | McCammon . | |
| 3,657,461 | 4/1972 | Freeman . | |
| 3,668,295 | 6/1972 | Broussard . | |
| 3,711,619 | 1/1973 | Jones et al. . | |
| 3,715,446 | 2/1973 | Kosinski . | |
| 3,725,561 | 4/1973 | Paul . | |
| 3,902,394 | 9/1975 | Stich . | |
| 3,911,777 | 10/1975 | Rendell . | |
| 3,916,751 | 11/1975 | Stich . | |
| 3,962,946 | 6/1976 | Rickard . | |
| 3,983,777 | 10/1976 | Bartolini . | |
| 3,983,778 | 10/1976 | Bartolini . | |
| 3,992,972 | 11/1976 | Rickard . | |
| 4,010,334 | 3/1977 | Demeter . | |
| 4,026,178 | 5/1977 | Fuller . | |
| 4,050,341 | 9/1977 | Underwood . | |
| 4,056,255 | 11/1977 | Lace . | |
| 4,096,780 | 6/1978 | Dawson . | |
| 4,133,243 | 1/1979 | DiMarzio . | |
| 4,138,178 | 2/1979 | Miller et al. . | |
| 4,145,944 | 3/1979 | Helpinstill, II . | |
| 4,184,399 | 1/1980 | Zuniga . | |
| 4,188,849 | 2/1980 | Rickard . | |
| 4,220,069 | 9/1980 | Fender . | |
| 4,222,301 | 9/1980 | Valdez . | |

(List continued on next page.)

*Primary Examiner*—Stanley J. Witkowski
*Attorney, Agent, or Firm*—Bliss McGlynn, P.C.

[57] ABSTRACT

A sensor assembly for a stringed musical instrument having a plurality of movable strings including a case having a longitudinal channel, at least one magnet disposed in the longitudinal channel, at least one coil assembly disposed adjacent the magnet in the longitudinal channel, and an acoustic vibration receptor movable about the coil assembly wherein the acoustic vibration receptor receives acoustic vibrations created by the movable strings to create secondary vibrations receivable by the coil assembly.

18 Claims, 2 Drawing Sheets

U.S. PATENT DOCUMENTS

| | | |
|---|---|---|
| 4,261,240 | 4/1981 | Aaroe . |
| 4,268,771 | 5/1981 | Lace . |
| 4,269,103 | 5/1981 | Underwood . |
| 4,283,982 | 8/1981 | Armstrong . |
| 4,320,681 | 3/1982 | Altilio . |
| 4,364,295 | 12/1982 | Stich . |
| 4,372,186 | 2/1983 | Aaroe . |
| 4,378,722 | 4/1983 | Isakson . |
| 4,379,421 | 4/1983 | Nunan . |
| 4,394,830 | 7/1983 | Damiano . |
| 4,433,603 | 2/1984 | Siminoff . |
| 4,442,749 | 4/1984 | DiMarzio et al. . |
| 4,463,648 | 8/1984 | Fender . |
| 4,472,994 | 9/1984 | Armstrong . |
| 4,499,809 | 2/1985 | Clevinger . |
| 4,501,186 | 2/1985 | Ikuma . |
| 4,524,667 | 6/1985 | Duncan . |
| 4,535,668 | 8/1985 | Schaller . |
| 4,545,278 | 10/1985 | Gagon et al. . |
| 4,580,481 | 4/1986 | Schaller et al. . |
| 4,581,974 | 4/1986 | Fender . |
| 4,624,172 | 11/1986 | McDougall . |
| 4,632,003 | 12/1986 | Kopp . |
| 4,738,178 | 4/1988 | Deering . |
| 4,809,578 | 3/1989 | Lace, Jr. . |
| 4,854,210 | 8/1989 | Palazzolo . |
| 4,869,144 | 9/1989 | Lieber . |
| 4,872,386 | 10/1989 | Betticare . |
| 4,878,412 | 11/1989 | Resnick . |
| 4,885,970 | 12/1989 | Fender . |
| 4,911,054 | 3/1990 | McClish . |
| 4,941,389 | 7/1990 | Wendler . |
| 4,949,619 | 8/1990 | Frieherr von Maltzan . |
| 5,012,716 | 5/1991 | Pagelli . |
| 5,027,691 | 7/1991 | Kennedy . |
| 5,041,784 | 8/1991 | Giebeler . |
| 5,111,728 | 5/1992 | Blucher et al. . |
| 5,148,733 | 9/1992 | Beller . |
| 5,168,117 | 12/1992 | Anderson . |
| 5,189,241 | 2/1993 | Nakamura . |
| 5,221,805 | 6/1993 | Lace . |
| 5,252,777 | 10/1993 | Allen . |
| 5,290,968 | 3/1994 | Mirigliano et al. . |
| 5,292,998 | 3/1994 | Knapp . |
| 5,292,999 | 3/1994 | Tumura . |
| 5,311,806 | 5/1994 | Riboloff . |
| 5,376,754 | 12/1994 | Stich . |
| 5,389,731 | 2/1995 | Lace . |
| 5,391,831 | 2/1995 | Lace . |
| 5,391,832 | 2/1995 | Lace . |
| 5,399,802 | 3/1995 | Blucher . |
| 5,408,043 | 4/1995 | Lace . |
| 5,422,432 | 6/1995 | Lace . |

SENSOR ASSEMBLY FOR STRINGED MUSICAL INSTRUMENTS

BACKGROUND OF THE INVENTION

1. Field of the Invention

The present invention relates generally to musical instruments and, more particularly, to a sensor assembly for use with stringed musical instruments.

2. Description of the Related Art

Generally, stringed musical instruments such as electric guitars have electromagnetic sensors or pick-ups for sensing mechanical vibrations of the strings and converting such into electrical signals. The electrical signals from the electromagnetic sensors are amplified and modified and, ultimately, reconverted into acoustical energy to produce music and the like.

These electromagnetic sensors, however, cannot accurately transform acoustic energy into an electric signal when either the susceptibility of the strings is negligible or when the strings are not equidistant from the electromagnetic sensor due to the shape of the stringed musical instrument. Stringed musical instruments which are used with strings fabricated from synthetic or organic materials are not magnetically susceptible and, therefore, do not affect the magnetic field created by the electromagnetic sensors through which the strings are moving. Even if the strings are magnetically susceptible, they may be strung across an arcuate bridge member which would place each of the strings at a different distance from the electromagnetic sensor thus differing the affect each of the strings has on the electromagnetic sensor. More specifically, the strings that are closer to the electromagnetic sensor will produce a resulting output higher in magnitude than the strings that are farther from the electromagnetic sensor, regardless of how the strings are played.

U.S. Pat. No. 2,976,755, issued to Fender on Mar. 28, 1961, discloses an electromagnetic sensor having mounting screws which adjust the coils so that the electromagnetic sensor may be properly tuned to the stringed musical instrument. Although spatial in nature, the adjustment capabilities are based on the assumption that the movable strings are in a plane defined thereby. This electromagnetic sensor suffers from the disadvantage that it cannot adapt to stringed musical instruments wherein the strings do not define a single plane which results in magnitude variations in the signal produced by the electromagnetic sensor.

SUMMARY OF THE INVENTION

It is, therefore, one object of the present invention to provide a sensor assembly for a stringed musical instrument.

It is another object of the present invention to provide an electromagnetic sensor capable of detecting the movement of strings having little magnetic susceptibility.

It is a further object of the present invention to provide an electromagnetic sensor capable of detecting the amplitude of movement of the strings regardless of their locations respective to each other and the electromagnetic sensor.

To achieve the foregoing objects, the present invention is a sensor assembly for a stringed musical instrument having a plurality of movable strings including a case having a longitudinal channel. The sensor assembly also includes at least one magnet disposed in the longitudinal channel and at least one coil disposed adjacent the magnet in the longitudinal channel. The sensor assembly further includes an acoustic vibration receptor movable about the coil wherein the acoustic vibration receptor receives acoustic vibrations created by the movable strings to create secondary vibrations receivable by the coil.

One advantage of the present invention is that a sensor assembly is provided for a stringed musical instrument. Another advantage of the present invention is that the sensor assembly provides sensitivity for stringed musical instruments which are not strung with magnetically susceptible strings. A further advantage of the present invention is that the sensor assembly equalizes the affect each string has on the electromagnetic sensor regardless of the distance the string is from the electromagnetic sensor.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
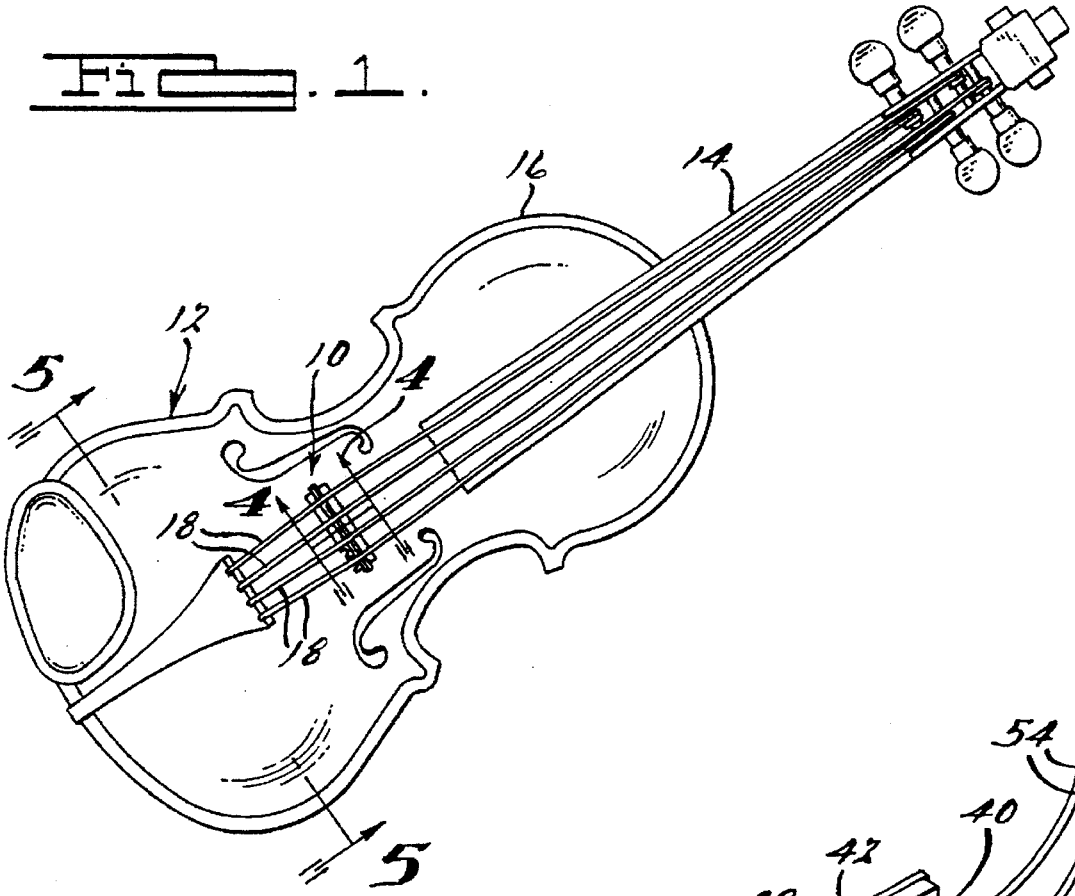
FIG. 1 is a plan view of a sensor assembly, according to the present invention, illustrated in operational relationship with a stringed musical instrument.

Referring to the drawings and, in particular, to FIG. 1, one embodiment of a sensor assembly 10, according to the present invention, is illustrated in operational relationship with a stringed musical instrument, such as a violin, generally indicated at 12. The violin 12 is of the acoustical type having a neck portion 14, a body portion 16, and a plurality of strings 18 extending along the neck and body portions 14 and 16, respectively. The sensor assembly 10 is disposed beneath the strings 18 and mounted to the body portion 16 in a manner to be described. Although the sensor assembly 10 is illustrated with a violin 12, it should be appreciated by those skilled in the art that any suitable type of stringed musical instrument may be enhanced by the sensor assembly 10.

Figure 2:
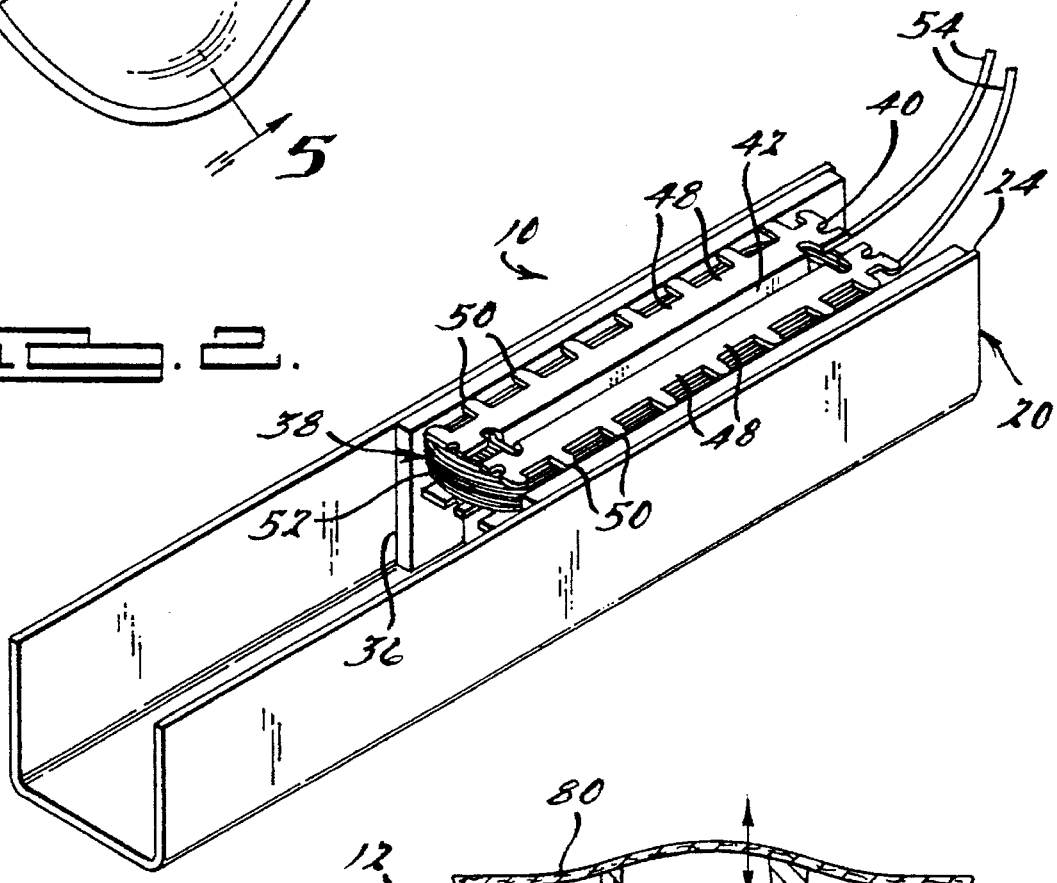
FIG. 2 is perspective view of a portion of the sensor assembly of FIG. 1.
Figure 3:
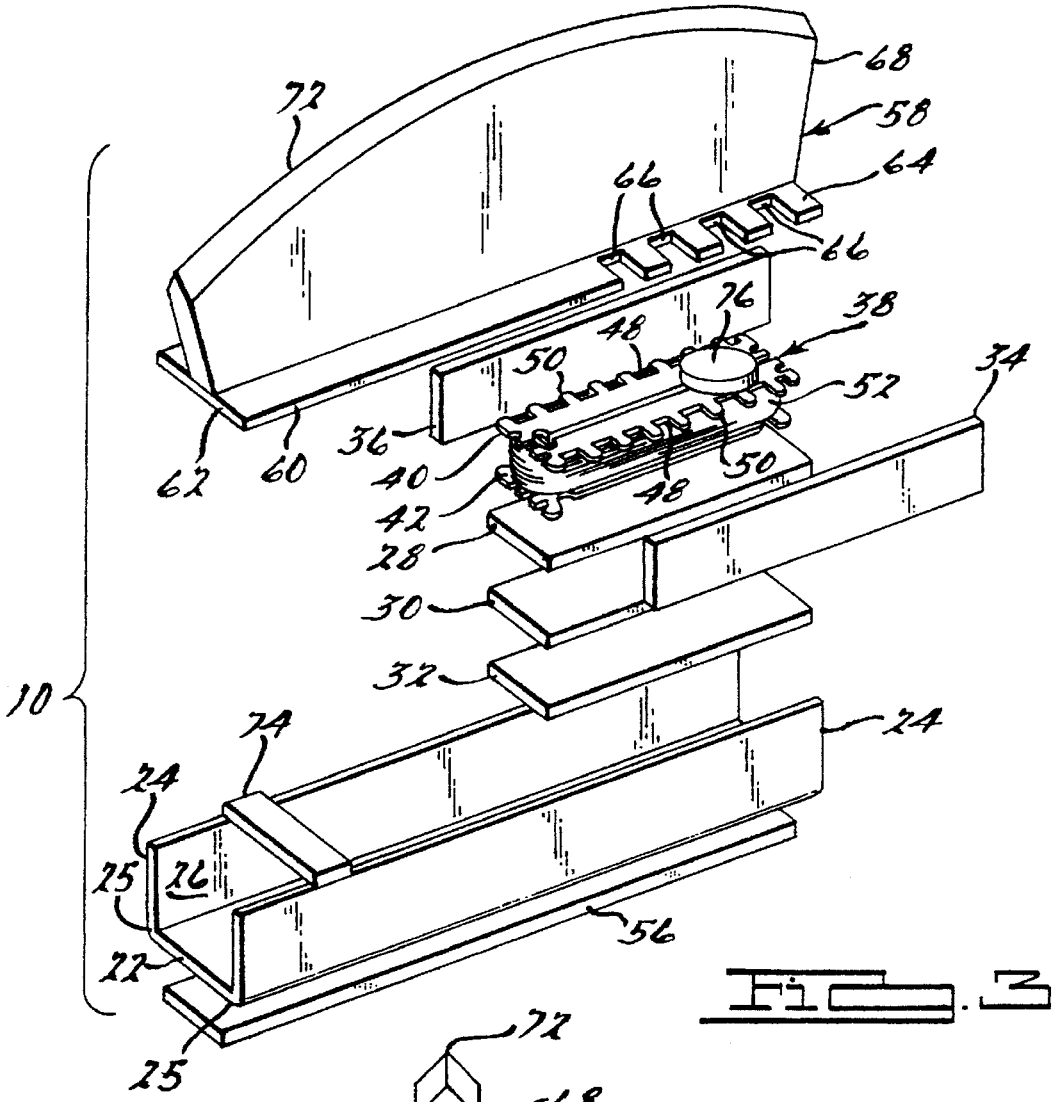
FIG. 3 is an exploded perspective view of the sensor assembly of FIG. 1.
Figure 4:
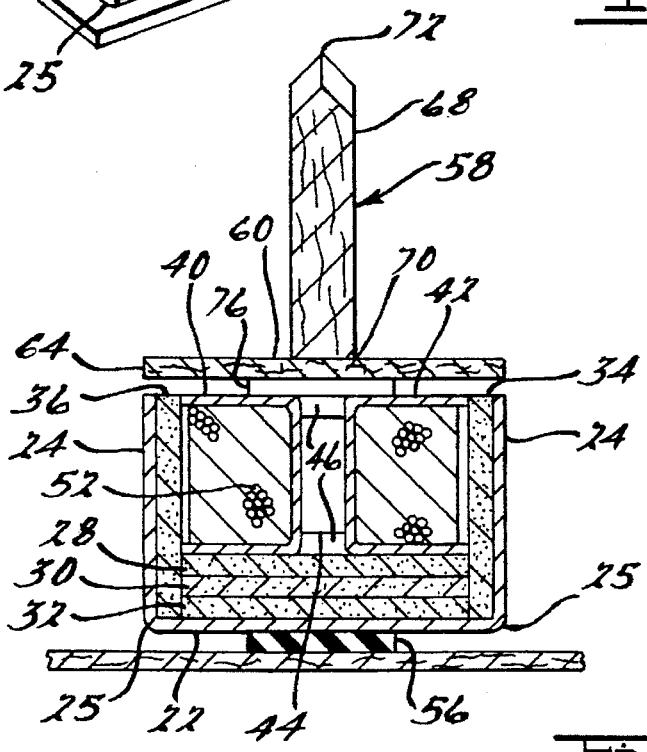
FIG. 4 is a sectional view taken along line 4—4 of FIG. 1.

Referring to FIGS. 2 through 4, the sensor assembly 10 includes a case 20 extending longitudinally and having a general "U" shape cross-section. The case 20 has a generally planar base wall 22 and a pair of generally planar side walls 24 substantially parallel to each other and connected by generally arcuate shaped corner walls 25 to the base wall 22 to form a longitudinal channel 26. Preferably, the longitudinal channel 26 has a lateral width greater than a height thereof. The case 20 is fabricated from a single piece of ferromagnetic material such as an iron based steel.

The sensor assembly 10 also includes at least one magnet 28 disposed in the longitudinal channel 26 along an interior surface of the base wall 22 and side walls 24 of the longitudinal channel 26. The magnet 28 is secured to the interior surface of the case 20 by suitable means such as an adhesive bonding agent. The magnet 28 is a permanent magnet strip and is made of a flexible permanent magnet material such as PLASTIFORM® which is commercially available from Arnold Engineering, Marango, Ill. The magnet 28 extends longitudinally and is generally rectangular in shape. Preferably, the sensor assembly 10 includes a plurality of magnets 28, 30, 32, 34, 36. Three of the magnets 28, 30, 32 are stacked one on top of each other and secured to the base wall 22 with the remaining two magnets 34, 36 secured to each of the side walls 24 such that neither magnet 34, 36 extends above the side walls 24.

The sensor assembly 10 further includes at least one coil assembly, generally indicated at 38. The coil assembly 38 is disposed in the longitudinal channel 26 adjacent the magnet 28. More specifically, the coil assembly 38 sits on the magnet 28 between the two magnets 34, 36. The coil assembly 38 includes a pair of core or frame pieces 40, 42 having a general "C-shape." The core pieces 40 and 42 are made of a ferromagnetic material such as an iron based steel. The core pieces 40, 42 are oriented in a back to back relationship. The coil assembly 38 also includes at least one insulating spacer 44 disposed between the core pieces 40, 42 to form a gap 46 therebetween such that the core pieces 40, 42 do not directly contact each other. The core pieces 40, 42 have a plurality of recesses 48 at exposed exterior edges thereof to define rows of tooth-like projections or teeth 50 for a function to be described.

The coil assembly 38 further includes a conductive wire 52 such as copper wrapped or wound around the core pieces 40, 42 in one direction to form a coil. In one embodiment, the conductive wire 52 is a fine copper wire. The coil assembly 38 has a pair of leads 54 extending outwardly from one end thereof and from one end of the longitudinal channel 26. The leads 54 are connected to a socket (not shown) on a stringed musical instrument 12 for connection to an amplifier and speaker system (not shown) as is known in the art.

The sensor assembly 10 also includes an insulator 56 which insulates the sensor assembly 10 from microvibrations created by the stringed musical instrument 12. The insulator 56 is made of an insulating material, preferably rubber. The insulator 56 is disposed between the bottom of the case 20 and a surface of the body portion 16.

The sensor assembly 10 further includes an acoustic vibration receptor, generally shown at 58. The acoustic vibration receptor 58 receives acoustic vibrations created by the movable strings 18 to create secondary vibrations receivable by the coil assembly 38. The acoustic vibration receptor 58 includes a resonating plate 60 which moves in response to the secondary vibrations, which movement affects the magnetic fields created by the coil assembly 38 such that the voltage signal passing through the coil assembly 38 changes. The resonating plate 60 is fabricated from a ferromagnetic material such as cold rolled steel. The resonating plate 60 extends between a first end 62 and a second end 64. The length of the resonating plate 60 is greater than that of the coil assembly 38. The resonating plate 60 includes a plurality of lateral notches 66 cut into the sides of the second end 64 of the resonating plate 60 to create a more violent magnetic field. Preferably, there are four to six notches 66 in each side of the second end 64. Preferably, these notches 66 are sharp and unfinished.

The acoustic vibration receptor 58 also includes a bridge 68 extending away from the coil assembly 38 toward the movable strings 18. The bridge 68 is secured to the resonating plate 60 such that there is no lost motion therebetween. The bridge 68 extends outwardly from the resonating plate 60 and perpendicularly thereto. The bridge 68 is a thin plate made of solid acrylic or other such material not susceptible to a magnetic field which is incompressible allowing it to transmit vibrations without distortion.

The bridge 68 includes a base end 70 and a distal end 72. The base end 70 is fixedly secured to the resonating plate 60 via any suitable securing device, such as an adhesive epoxy. The distal end 72 is a sharp edge which receives the movable strings 18 thereon. The distal end 72 is curvilinear allowing it to apply equal pressure on each of the movable strings 18 so that each of the movable strings 18 affects or moves the bridge 68 equally. Therefore, movement of each of the movable strings 18 results in an equal vibration received by the bridge 68 which is then transmitted to the resonating plate 60. It should be appreciated by those skilled in the art that the curvilinear shape of the distal end 72 may vary depending on the type of stringed musical instrument 12 used. It should also be appreciated by those skilled in the art that the distal end 72 may even be straight for such instruments as acoustic guitars, banjos, ukeleles, and the like wherein the strings all are set in a single plane.

The sensor assembly 10 also includes a pivot bar 74 which defines a fulcrum for the first end 62 of the resonating plate 60 such that the acoustic vibration receptor 58 pivots about the pivot bar 74. More specifically, the pivot bar 74 allows the resonating plate 60 to vibrate based on the vibrations received from the bridge 68 as the bridge vibrates due to the movement of the movable strings 18. Absence of the pivot bar 74 would force the resonating plate 60 to rest on the side walls 24 of the case 20 preventing the resonating plate 60 from resonating or vibrating to the extent necessary to transform the full range of acoustic vibrations into a voltage signal.

The sensor assembly 10 further includes a resonating plate base 76 disposed between the coil assembly 38 and the second end 64 of the resonating plate 60. The resonating plate base 76 is fabricated from a resilient material capable of returning to its original shape after it has been deformed, i.e., the material has spacial memory. In one embodiment, the resonating plate base 76 is a rubber washer. When the resonating plate 60 vibrates, the resonating plate base 76 allows the resonating plate 60 to move or pivot about the pivot bar 74. When the resonating plate 60 is no longer vibrating, the resonating plate base 76 returns the resonating plate 60 and the bridge 68 to the position in which it started when the movable strings 18 were stationary.

Figure 5:
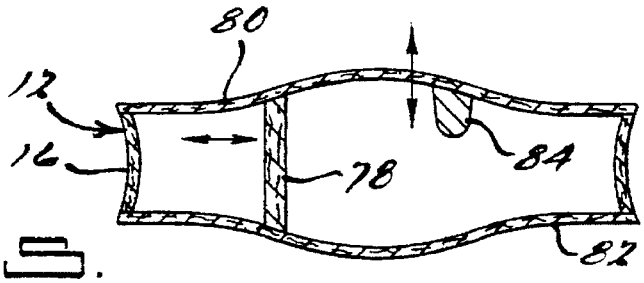
FIG. 5 is a sectional view of the stringed musical instrument taken along line 5—5 of FIG. 1.

Referring to FIG. 5, the violin 12 includes a pivotable sound post 78 extending from a front face 80 to a back face 82 thereof. The sound post 78 helps the violin 12 create higher pitched sounds. The violin 12 also includes a base bar 84 extending along the front face 80 of the violin 12 perpendicularly thereto and in a spaced relationship therefrom. More specifically, the sound post 78 and the base bar 84 are perpendicular to each other and do not touch each other. The sensor assembly 10 is placed between the front face 80 and the movable strings 18 replacing the instrument bridge (not shown). The acoustic vibration receptor 58, pivot bar 74 and resonating plate base 76 cooperate together to mimic the movement of the sound post 78 and base bar 84 of the violin 12.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A sensor assembly for a stringed musical instrument having a plurality of movable strings comprising:

a case having a longitudinal channel;

at least one magnet disposed in said longitudinal channel;

at least one coil assembly disposed adjacent said at least one magnet in said longitudinal channel; and an acoustic vibration receptor having a resonating plate extending longitudinally above said at least one coil assembly and a bridge extending longitudinally and perpendicularly from said resonating plate and contacting the moveable strings, said acoustic vibration receptor being movable about said at least one coil assembly wherein said acoustic vibration receptor receives primary vibrations created by the movable strings to create secondary vibrations receivable by said at least one coil assembly.

2. A sensor assembly as set forth in claim 1 wherein said bridge includes a base end secured to said resonating plate and a distal end, said distal end receiving the movable strings thereon.

3. A sensor assembly as set forth in claim 2 wherein said distal end is curvilinear.

4. A sensor assembly as set forth in claim 2 wherein said acoustic vibration receptor further includes a pivot bar defining a fulcrum for a first end of said resonating plate such that said acoustic vibration receptor pivots about said pivot bar.

5. A sensor assembly as set forth in claim 4 wherein said acoustic vibration receptor further includes a resonating plate base disposed between said at least one coil assembly and a second end of said resonating plate.

6. A sensor assembly as set forth in claim 5 wherein said resonating plate base is fabricated from resilient material.

7. A sensor assembly as set forth in claim 1 wherein said resonating plate is fabricated from a ferromagnetic material.

8. A sensor assembly as set forth in claim 1 wherein said resonating plate includes a plurality of lateral notches.

9. A sensor assembly as set forth in claim 1 including a vibration isolator disposed between said case and the stringed musical instrument.

10. A sensor assembly as set forth in claim 8 wherein said at least one magnet is generally rectangular in shape.

11. A sensor assembly as set forth in claim 1 wherein said case extends longitudinally and has a general U-shape.

12. A sensor assembly as set forth in claim 1 wherein said case further includes a pair of generally planar side walls substantially parallel to each other disposed on two sides to form said longitudinal channel.

13. A sensor assembly as set forth in claim 1 wherein said at least one coil includes a pair of longitudinally extending core pieces having a plurality of spaced projections along one edge thereof, said core pieces being C-shaped and a spacer disposed therebetween in a back to back relationship.

14. A sensor assembly as set forth in claim 13 wherein said at least one coil assembly further includes a wire wrapped around said core pieces.

15. A sensor assembly as set forth in claim 14 wherein said spacer is fabricated of an electromagnetically insulating material.

16. A sensor assembly for a stringed musical instrument having a plurality of movable strings comprising:

a case having a longitudinal channel;

at least one magnet disposed in said longitudinal channel;

at least one coil assembly disposed adjacent said at least one magnet in said longitudinal channel;

a pivot bar extending transversely across said longitudinal channel;

an acoustic vibration receptor having a resonating plate extending longitudinally above said at least one coil assembly and said pivot bar defining a fulcrum for a first end of said resonating plate and a bridge extending longitudinally and perpendicularly from said resonating plate, said acoustic vibration receptor being pivotal about said pivot bar wherein said acoustic vibration receptor receives primary vibrations created by the movable strings to create secondary vibrations receivable by said at least one coil assembly; and wherein said bridge includes a sharp distal end extending out toward and contacting the movable strings.

17. A sensor assembly as set forth in claim 16 wherein said distal end is curvilinear.

18. A sensor assembly for a stringed musical instrument having a plurality of movable strings, a sound post and a base bar spaced a distance apart, said sensor assembly comprising:

a case having a longitudinal channel;

at least one magnet disposed in said longitudinal channel;

a coil assembly disposed adjacent said at least one magnet in said longitudinal channel;

a pivot bar extending transversely across said longitudinal channel;

a resonating plate base secured to said coil assembly spaced a predetermined distance from said pivot bar; and an acoustic vibration receptor having a resonating plate extending longitudinally and being disposed upon said pivot bar and said resonating plate base and a bridge extending longitudinally and perpendicularly from said resonating plate and contacting the moveable strings, said resonating plate being pivotable about said pivot bar wherein said acoustic vibration receptor receives primary vibrations created by the movable strings to create secondary vibrations receivable by said coil assembly.

* * * * *

UNITED STATES PATENT AND TRADEMARK OFFICE

CERTIFICATE OF CORRECTION

PATENT NO. : 5,641,932

DATED : June 24, 1997

INVENTOR(S) : Jeffrey J. Lace

It is certified that error appears in the above-identified patent and that said Letters Patent is hereby corrected as shown below:

On the title page, item [56] page 2, line 10,

"Giebeler" should be "Griebeler".

Column 5, claim 6, line 35, before "resonating" insert --a--.

Signed and Sealed this

Ninth Day of December, 1997

*Attest:*

BRUCE LEHMAN

*Attesting Officer*

*Commissioner of Patents and Trademarks*